US005676586A

United States Patent [19]

James

[11] Patent Number: 5,676,586

[45] Date of Patent: Oct. 14, 1997

[54] MODEL CAR RACE TRACK

[76] Inventor: David Eric James, 44 Via Joaquin, Rancho Santa Margarita, Calif. 92688

[21] Appl. No.: 654,161

[22] Filed: May 28, 1996

[51] Int. Cl.[6] ..... A63H 18/02

[52] U.S. Cl. ..... 446/444; 463/58; 463/59

[58] Field of Search ..... 446/445, 444, 446/457; 273/441, 442, 445; 463/58, 59, 62, 63

[56] References Cited

U.S. PATENT DOCUMENTS

| | | | |
|---|---|---|---|
| 2,846,225 | 8/1958 | Keyser | 463/58 |
| 2,862,333 | 12/1958 | Gardiol | 446/444 |
| 3,667,672 | 6/1972 | Kennedy et al. | 463/59 |
| 3,707,804 | 1/1973 | Cook | 463/63 |
| 3,735,923 | 5/1973 | Brigham et al. | 463/58 |
| 3,860,237 | 1/1975 | Cooper et al. | 463/58 |
| 3,970,309 | 7/1976 | Sato | 463/59 |
| 4,346,894 | 8/1982 | Cooper et al. | 463/63 |
| 4,364,566 | 12/1982 | Neuhierl | 446/444 |
| 4,382,599 | 5/1983 | Tilbor | 446/444 |
| 4,715,602 | 12/1987 | May et al. | 463/58 |
| 5,435,553 | 7/1995 | Arima et al. | 273/442 |

*Primary Examiner*—Robert A. Hafer
*Assistant Examiner*—Jeffrey D. Carlson

[57] ABSTRACT

A model car race track for guiding remote control cars traveling along a ground surface. The inventive device includes a plurality of straight members and elbow members which can be coupled together and laid upon a ground surface to form an enclosed track within which a remote control car can be navigated upon the ground surface. A jump, a lap counter, and an end ramp can be coupled with the straight and elbow members for incorporation into the track.

1 Claim, 3 Drawing Sheets

FIG 3
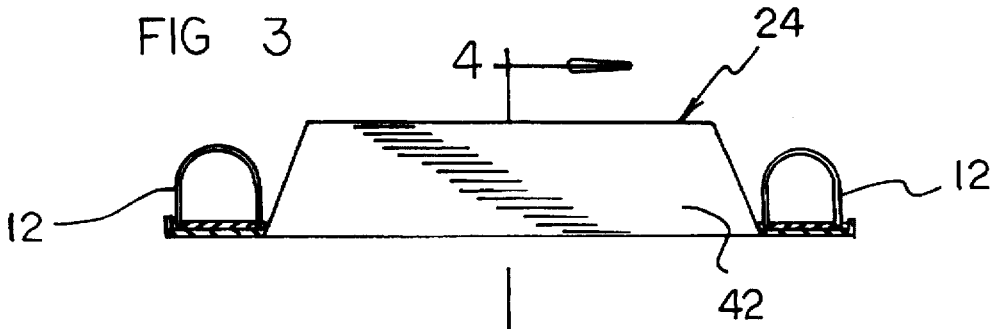
FIG 4
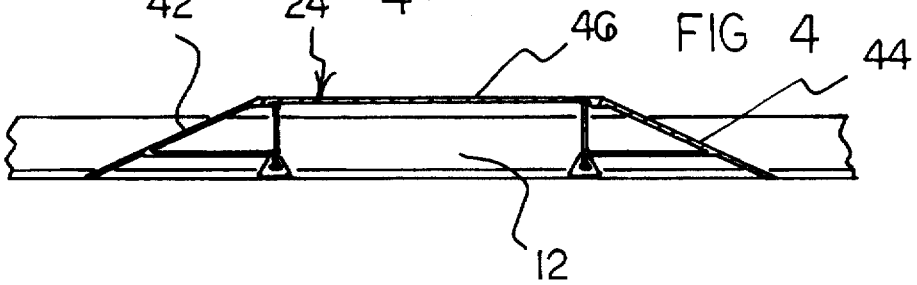
FIG 5
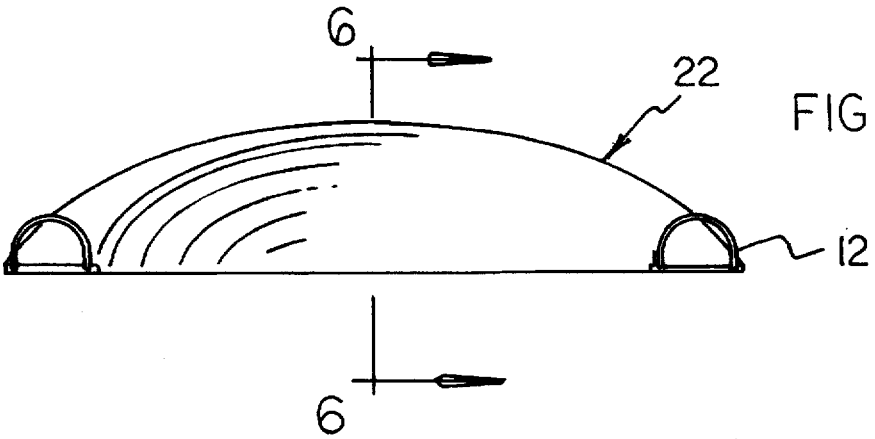
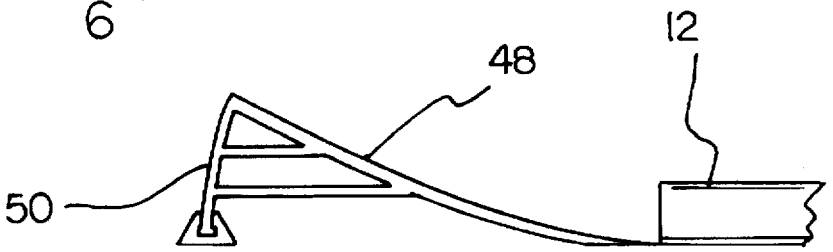
FIG 6

FIG 7
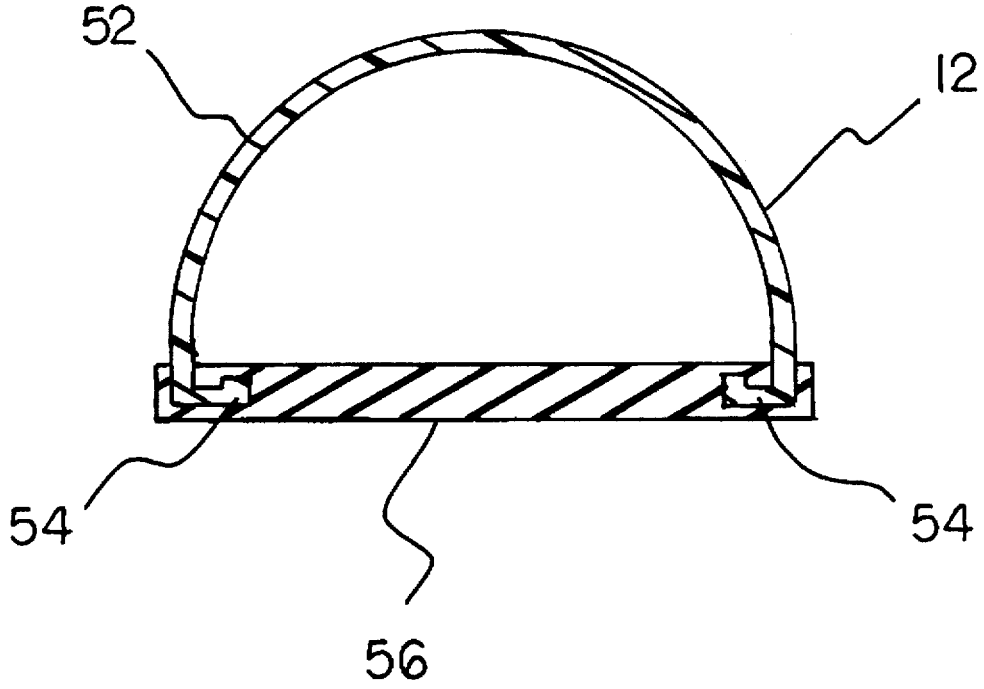
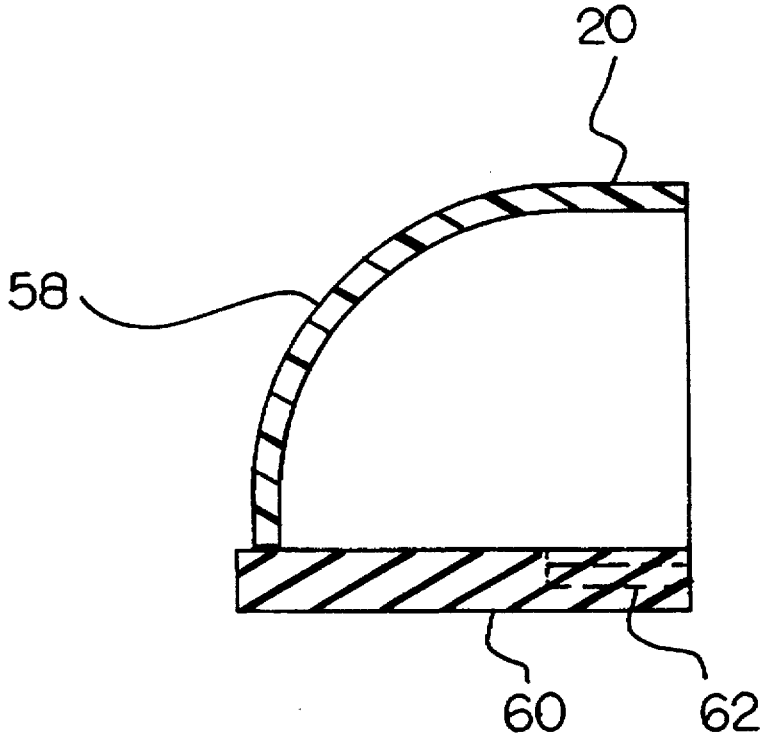
FIG 8

MODEL CAR RACE TRACK

BACKGROUND OF THE INVENTION

1. Field of the Invention

The present invention relates to race car guiding devices and more particularly pertains to a model car race track for guiding remote control cars traveling along a ground surface.

2. Description of the Prior Art

The use of race car guiding devices is known in the prior art. More specifically, race car guiding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art race car guiding devices include U.S. Pat. No. 5,162,009; U.S. Pat. No. 5,038,685; U.S. Design Pat. No. 257,272; U.S. Pat. No. 4,697,812; U.S. Pat. No. 4,925,188; and U.S. Pat. No. 4,937,207.

While these devices fulfill their respective, particular objectives and requirements, the aforementioned patents do not disclose a model car race track for guiding remote control cars traveling along a ground surface which includes a plurality of straight members and elbow members which can be coupled together and laid upon a ground surface to form an enclosed track within which a remote control car can be navigated upon the ground surface, and a jump, a lap counter, and an end ramp which can be coupled with the straight and elbow members for incorporation into the track.

In these respects, the model car race track according to the present invention substantially departs from the conventional concepts and designs of the prior art, and in so doing provides an apparatus primarily developed for the purpose of guiding remote control cars traveling along a ground surface.

SUMMARY OF THE INVENTION

In view of the foregoing disadvantages inherent in the known types of race car guiding devices now present in the prior art, the present invention provides a new model car race track construction wherein the same can be utilized for guiding remote control cars traveling along a ground surface. As such, the general purpose of the present invention, which will be described subsequently in greater detail, is to provide a new model car race track apparatus and method which has many of the advantages of the race car guiding devices mentioned heretofore and many novel features that result in a model car race track which is not anticipated, rendered obvious, suggested, or even implied by any of the prior art race car guiding devices, either alone or in any combination thereof.

To attain this, the present invention generally comprises a model car race track for guiding remote control cars traveling along a ground surface. The inventive device includes a plurality of straight members and elbow members which can be coupled together and laid upon a ground surface to form an enclosed track within which a remote control car can be navigated upon the ground surface. A jump, a lap counter, and an end ramp can be coupled with the straight and elbow members for incorporation into the track.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new model car race track apparatus and method which has many of the advantages of the race car guiding devices mentioned heretofore and many novel features that result in a model car race track which is not anticipated, rendered obvious, suggested, or even implied by any of the prior art race car guiding devices, either alone or in any combination thereof.

It is another object of the present invention to provide a new model car race track which may be easily and efficiently manufactured and marketed.

It is a further object of the present invention to provide a new model car race track which is of a durable and reliable construction.

An even further object of the present invention is to provide a new model car race track which is susceptible of a low cost of manufacture with regard to both materials and labor, and which accordingly is then susceptible of low prices of sale to the consuming public, thereby making such model car race tracks economically available to the buying public.

Still yet another object of the present invention is to provide a new model car race track which provides in the apparatuses and methods of the prior art some of the advantages thereof, while simultaneously overcoming some of the disadvantages normally associated therewith.

Still another object of the present invention is to provide a new model car race track for guiding remote control cars traveling along a ground surface.

Yet another object of the present invention is to provide a new model car race track which includes a plurality of straight members and elbow members which can be coupled together and laid upon a ground surface to form an enclosed track within which a remote control car can be navigated upon the ground surface, and a jump, a lap counter, and an end ramp which can be coupled with the straight and elbow members for incorporation into the track.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of a jump of the invention.

FIG. 4 is a cross sectional view taken along line 4—4 of FIG. 3.

FIG. 5 is a front elevational view of an end ramp of the invention.

FIG. 6 is a cross sectional view taken along line 6—6 of FIG. 5.

FIG. 7 is a cross sectional view of a straight member of the invention.

FIG. 8 is a cross sectional view of an end member of the invention.

Similar reference characters refer to similar parts throughout the several views of the drawings.

DESCRIPTION OF THE PREFERRED EMBODIMENT

Figure 1:
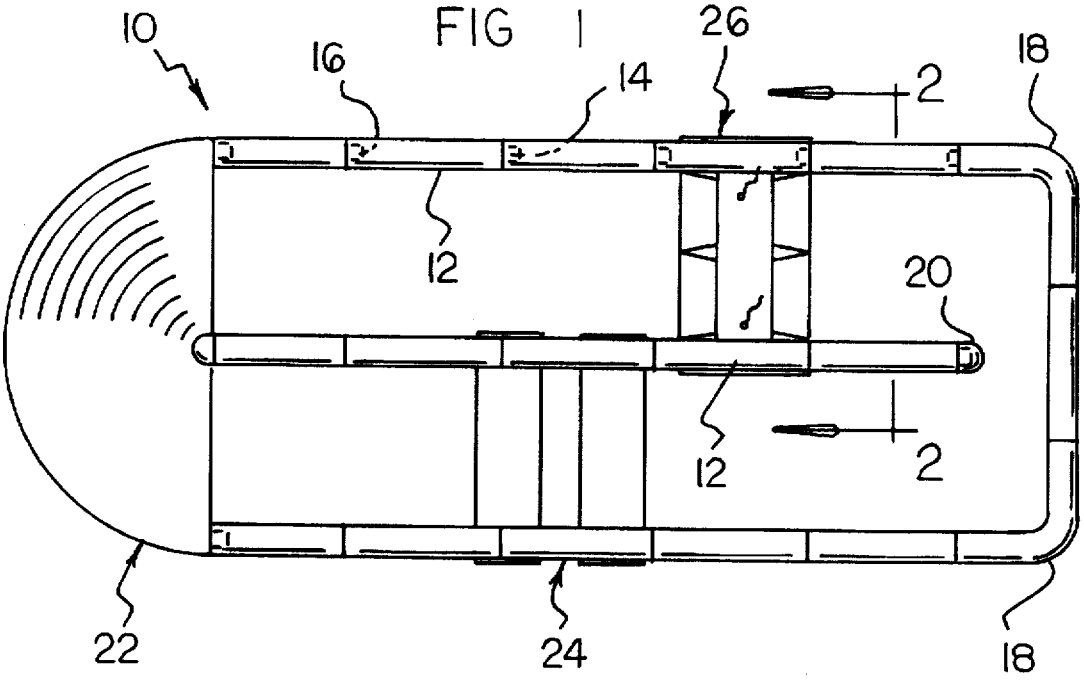
FIG. 1 is a top plan view of the preferred embodiment of the model car race track constructed in accordance with the principles of the present invention.

With reference now to the drawings, and in particular to FIGS. 1–8 thereof, a new model car race track embodying the principles and concepts of the present invention and generally designated by the reference numeral 10 will be described.

More specifically, it will be noted that the model car race track 10 comprises a plurality of straight members 12 having coupling projections 14 and coupling apertures 16 which can be interconnected to couple the straight members 12 together in a linear orientation. Elbow members 18 also include the coupling projections 14 and the coupling apertures 16 to allow coupling of the elbow members 18 with the straight members 12. One or more end members 20 can be provided for terminating a straight or elbow member 12 or 14 within the track when assembled as shown in FIG. 1. By this structure, the members 12, 18, and 20 can be interconnected by the coupling projections 14 to form an enclosed track upon a ground surface, whereby an independently powered remote control car can be run on the ground surface within the track 10.

The straight members, elbow members and end ramp members are coupled together by a plurality of coupling projections 14 and coupling apertures 16. The coupling projections and apertures join the straight, elbow and end ramp members into one contiguous piece to stabilize the track during use. The various members include holes to permit receipt of decorative flags. The various components of the apparatus are available separately to permit expansion of the race track. In varying embodiments of the apparatus the race track may be configured in a plurality of different shapes and sizes.

As shown in FIG. 1, the invention may additionally include an end ramp 22 which can be coupled to the straight members 12. The end ramp 22 provides a banked surface which allows a remote control car to turn when travelling through the created track 10 at a greater speed than possible along the ground surface. A jump 24 and a lap counter 26 can be interposed between the straight members 12 to allow the remote control car to become airborne and to count the number of laps the car has completed through the course.

Figure 2:
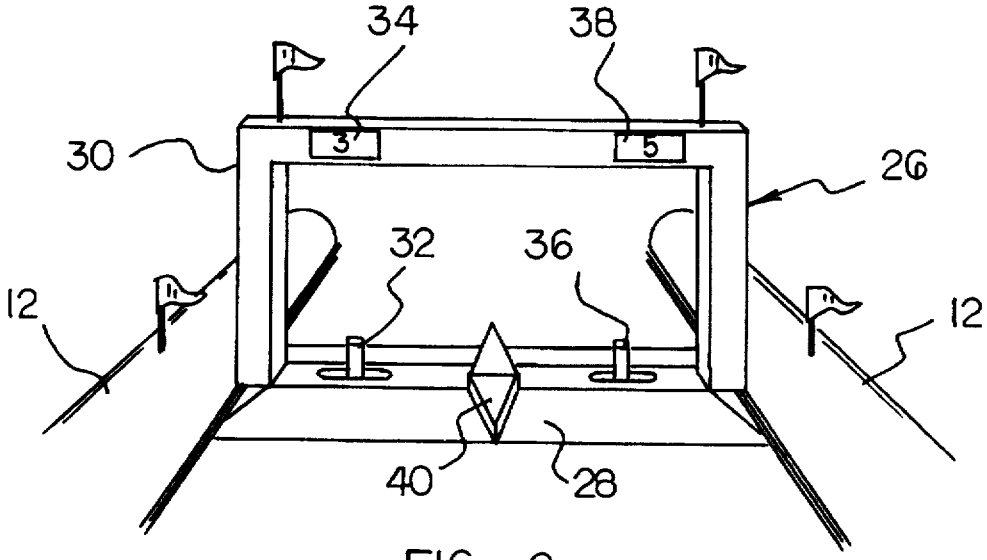
FIG. 2 is a front perspective illustration of a lap counter of the present invention taken from line 2—2 of FIG. 1.

As shown in FIG. 2, the lap counter 26 comprises a pair of the straight members 12 positioned in a spaced and substantially parallel orientation. A transverse member 28 extends orthogonally between the pair of straight members 12 and a hollow frame 30 extends up and over the transverse member. A first actuator 32 is mounted on a first side of the transverse member 28 and is responsive to contact with a remote control car when such is driven over the transverse member to actuate through conventionally known means a first indicator 34. The first indicator 34 is mounted to the hollow frame for viewing by a driver of the car and operates to record the number of laps through the course completed by that driver. Similarly, a second actuator 36 is mounted on a second side of the transverse member 28 and is responsive to contact with a remote control car when such is driven over the transverse member to actuate through conventionally known means a second indicator 38 mounted to the hollow frame 30. A dividing member 40 is mounted to a medial portion of the transverse member 28 and serves to separate the transverse member to preclude unintentional operation of one of the actuators 32 or 36 by a remote control car attempting to operate another one of the actuators.

Referring to FIGS. 3 and 4, it can be shown that the jump 24 comprises a second pair of the straight members 12 positioned in a spaced and substantially parallel orientation. A first inclined panel 42 extends orthogonally between the second pair of straight members 12. Similarly, a second inclined panel 44 extends orthogonally between the second pair of straight members 12 and is spaced from and inclined in a direction opposite that of the first inclined panel 42. A center panel 46 extends between upper edges of the inclined panels 42 and 44 to support a remote control car going over the jump 24 which fails to become airborne.

As shown in FIGS. 5 and 6, the end ramp 22 preferably includes an inclined arcuate panel 48 which is banked and extends through an arc of at least 90 degrees. As shown in the drawings, the arcuate panel 48 extends through an arc of 180 degrees and is supported at an outer peripheral edge thereof by an outer supporting panel 50 which extends downwardly therefrom to rest upon a ground surface and support the arcuate panel in the banked orientation illustrated herein.

Turning now to FIGS. 7 and 8, it can be shown that the straight members 12 each comprise a semi-cylindrical member having longitudinal projections 54 extending at least partially along lower longitudinal edges of the semi-cylindrical member. The protections 54 are received within correspondingly shaped longitudinal grooves formed in an elastomeric base panel 56. The base panel 56 is planar and flexible so as to conform to a shape of a ground surface upon which the invention 10 is set up to prevent movement of the members 12, 18, and 20 during use of the invention.

As shown in FIG. 8, the end member 20 is comprised of a semi-spherical member 58 coupled to another elastomeric base panel 60 by another pair of longitudinal projections 62.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A model car race track kit comprising:

a plurality of straight members which can be coupled together and positioned upon a ground surface;

a plurality of elbow members which can be coupled to the straight members and positioned upon a ground surface;

an end ramp which can be coupled to the straight members and positioned upon a ground surface, whereby the members and the end ramp can be assembled into a track enclosing a portion of the ground surface such that a remote control car can be run upon the ground surface confined within the track, wherein the straight members, elbow members and end ramp members are coupled together by a plurality of coupling protections and coupling apertures, the coupling projections and apertures joining the straight, elbow and and ramp members into one contiguous piece to stabilize the track during use the members including holes to permit receipt of decorative flags, the end ramp includes an inclined arcuate panel which is banked and extends through an arc of at least 90 degrees, an outer supporting panel extending downwardly from an outer peripheral edge of the inclined arcuate panel;

a jump which can be interposed between the straight members, the jump comprises a second pair of straight members positioned in a spaced and substantially parallel orientation, a first inclined panel extending orthogonally between the second pair of straight members, a second inclined panel extending orthogonally between the second pair of straight members and spaced from and inclined in a direction opposite that of the first inclined panel, a center panel extending between upper edges of the inclined panel;

a lap counter means which can be interposed between the straight members for counting the number of laps the car has completed through the course, the lap counter comprises a pair of straight members positioned in a spaced and substantially parallel orientation, a transverse member extending orthogonally between the pair of straight members and disposed on the ground surface, a hollow frame extending up and over the transverse member, a first actuator mounted on a first side of the transverse member and responsive to contact with a remote control car when the remote control car is driven over the transverse member, a first indicator mounted to the frame and positioned in mechanical communication with the first actuator, a second actuator mounted on a second side of the transverse member and responsive to contact with a remote control car when the remote control car is driven over the transverse member, a second indicator mounted to the frame positioned in mechanical communication with the second actuator, a dividing member mounted to a medial portion of the transverse member disposed between the first and second actuator.

* * * * *